US009902192B1

(12) United States Patent
Crowley

(10) Patent No.: US 9,902,192 B1
(45) Date of Patent: Feb. 27, 2018

(54) SYSTEM AND METHOD FOR HIGH-SPEED INSERTION OF ENVELOPES

(71) Applicant: H. W. Crowley, Eliot, ME (US)

(72) Inventor: H. W. Crowley, Eliot, ME (US)

( * ) Notice: Subject to any disclaimer, the term of this patent is extended or adjusted under 35 U.S.C. 154(b) by 677 days.

(21) Appl. No.: 14/254,741

(22) Filed: Apr. 16, 2014

Related U.S. Application Data

(62) Division of application No. 12/857,702, filed on Aug. 17, 2010, now abandoned, which is a division of application No. 12/204,773, filed on Sep. 4, 2008, now Pat. No. 7,775,015.

(60) Provisional application No. 60/969,912, filed on Sep. 4, 2007.

(51) Int. Cl.
*B43M 3/04* (2006.01)
*B43M 7/00* (2006.01)

(52) U.S. Cl.
CPC ..... *B43M 3/045* (2013.01); *B43M 3/04* (2013.01); *B43M 7/004* (2013.01)

(58) Field of Classification Search
CPC ..... B43M 3/00; B43M 3/04; B43M 3/045; B43M 7/004
USPC ..... 53/52, 55, 77, 284.3, 500, 498, 499, 494
See application file for complete search history.

(56) References Cited

U.S. PATENT DOCUMENTS 1,894,427 A * 1/1933 Commodore ..... B43M 5/02 118/401
1,916,847 A * 7/1933 McCarthy ..... B43M 3/045 53/154
2,077,780 A * 4/1937 Storck ..... B43M 5/02 118/401
2,167,252 A * 7/1939 Rouan ..... B43M 11/00 118/401
2,243,536 A * 5/1941 Rouan ..... B43M 11/02 137/118.01
2,325,455 A 7/1943 Williams
2,788,627 A * 4/1957 Bellows ..... B43M 3/00 53/284.3
3,154,899 A * 11/1964 Burns ..... B43M 3/00 53/384.1
3,732,664 A 5/1973 Blossom et al.
(Continued)

*Primary Examiner* — Christopher Harmon
(74) *Attorney, Agent, or Firm* — Loginov & Associates; William A. Loginov

(57) ABSTRACT

This invention overcomes the disadvantages of the prior art by providing a system and method for inserting contents into envelopes that generally reduces the number of operative device components, locates all components in a readily and accessible location, reduces the number of adjustments needed to change envelope size and contents size, provides an efficient and aesthetically pleasing design, allows for a highly flexible arrangement of backup hoppers to primary hoppers for feeding envelope contents and otherwise affords a substantial number of improvements over currently available envelope inserters. The illustrative embodiment includes a feed table with a low-slung swing arm for handling contents, a pivoting feed table that exposes the operative components on the underside, a novel raceway belt with projecting lugs for transporting contents to the insertion area, a primary and secondary contents hopper backup system, a mechanism for easily adjusting for different-sized envelopes, and a variety of other novel features.

8 Claims, 12 Drawing Sheets

(56) References Cited

U.S. PATENT DOCUMENTS 3,905,325 A * 9/1975 Labore ..... B43M 5/042 118/32
3,965,644 A 6/1976 Stocker
3,979,880 A 9/1976 Seragnoli
4,020,615 A 5/1977 Irvine et al.
4,202,483 A 5/1980 Sillars
4,577,848 A 3/1986 Hams
4,604,849 A 8/1986 Zemke et al.
4,614,508 A 9/1986 Kerivan
4,903,456 A 2/1990 Meur
4,939,887 A 7/1990 Haas et al.
4,986,522 A * 1/1991 Paulson ..... B65H 3/10 271/107
5,141,216 A 8/1992 Ballestrazzi et al.
5,282,350 A 2/1994 Crowley
5,321,624 A 6/1994 Helffrich et al.
5,401,013 A * 3/1995 Hurd ..... B65H 1/06 271/124
5,549,290 A * 8/1996 Long ..... B65H 1/02 271/166
5,722,221 A 3/1998 Maltman et al.
5,840,123 A * 11/1998 Holbrook ..... B43M 5/042 118/603
5,950,399 A * 9/1999 Viens ..... B43M 5/042 53/284.3
5,975,514 A 11/1999 Emigh et al.
6,094,894 A 8/2000 Yates
6,129,350 A 10/2000 St. Ours
6,164,046 A 12/2000 Werner et al.
6,168,008 B1 1/2001 Sting et al.
6,289,658 B1 9/2001 Sting et al.
6,460,439 B2 8/2002 Belanger
6,494,019 B1 12/2002 Lingle et al.
6,536,184 B1 3/2003 Sting et al.
6,663,100 B2 12/2003 Crowley
6,698,748 B1 3/2004 Crowley
6,763,648 B2 7/2004 Sting et al.
6,789,377 B2 9/2004 Sting et al.
6,964,146 B2 11/2005 LaRocca
7,152,386 B2 12/2006 Brauneis et al.
7,188,459 B2 3/2007 Brauneis et al.
7,198,262 B2 4/2007 Hartl et al.
7,213,808 B2 5/2007 Botschek et al.
7,232,122 B2 6/2007 Mayer et al.
7,395,639 B2 7/2008 Braunels et al.
2004/0020170 A1 2/2004 LaRocca
2007/0125045 A1* 6/2007 Sytema ..... B43M 3/045 53/460
2009/0000254 A1* 1/2009 Passoni ..... B43M 3/045 53/457

* cited by examiner

SYSTEM AND METHOD FOR HIGH-SPEED INSERTION OF ENVELOPES

RELATED APPLICATIONS

This application is a divisional of copending U.S. application Ser. No. 12/857,702, filed Aug. 17, 2010, entitled SYSTEM AND METHOD FOR HIGH-SPEED INSERTION OF ENVELOPES, the entire disclosure of which is herein incorporated by reference, which application is a divisional of copending U.S. application Ser. No. 12/204,773, filed Sep. 4, 2008, entitled SYSTEM AND METHOD FOR HIGH-SPEED INSERTION OF ENVELOPES, issued on Aug. 17, 2010 as U.S. Pat. No. 7,775,015, the entire disclosure of which is herein incorporated by reference, which claims the benefit of U.S. Provisional Application Ser. No. 60/969,912 entitled SYSTEM AND METHOD FOR HIGH-SPEED INSERTION OF ENVELOPES, by H. W. Crowley, filed Sep. 4, 2007, the entire disclosure of which are expressly incorporated herein by reference.

FIELD OF THE INVENTION

This invention relates to high-speed envelope inserters used for high-volume mailing operations.

BACKGROUND OF THE INVENTION

Current estimates place the number of envelopes used annually in the United States at over 100 billion. A significant percentage of these envelopes are used in connection with bulk mailings, and are accordingly filled, addressed and processed by a variety of automated devices. A lynchpin of all automated processes is the automatic envelope inserter. Automatic inserters are large, complex devices that are loaded with contents to be inserted (e.g., individual letter sheets and/or fillers) and envelopes in which these contents are to be inserted. Other devices such as binders, that bind inserts together (into a books, catalogs, newspapers or magazines), presses that apply logos and decoration, addressing devices, collating and a variety of other devices are also used selectively to process individual sheet-like materials in bulk mailing and other processes. These various devices can be termed generally "utilization devices" as they utilize sheet-like materials that are typically dispensed in stacks.

Reference is made generally to U.S. Pat. No. 6,698,748, entitled SYSTEM AND METHOD FOR SINGULATING A STACK OF SHEET-LIKE MATERIALS, by H. W. Crowley, the teachings of which are expressly incorporated herein by reference. FIG. 1 of the incorporated patent shows, by way of background, a high-volume envelope inserter in current use by industry and representing generally the state of the prior art. The depicted exemplary inserter (100—in which the following numbers in parenthesis represent reference numbers in the incorporated patent) is a large, modular unit that combines various contents stored in hoppers (not shown) in the rear (102) of the device and that directs (arrows 104 and 106) contents (105) onto a raceway (108) downstream (arrow 110) toward a stack of envelopes (112). At each point along the raceway, additional insert sheets are added to the contents. These contents may be folded, or otherwise compacted, to fit within the selected envelope by mechanism within the inserter. Envelopes are drawn from the stack (112), and directed downstream (arrow 114) to an inserting station (116) at which the closed-but-unsealed envelope flaps (118) are opened so that the final contents (120) can be inserted thereinto. The filled envelopes (122) are then transferred further downstream (arrow 124) to a stacking position or further-processing module (not shown).

Industrial inserters, referred to generically as swing-arm inserters, are available from a variety of well-known companies including Bell & Howell (Phillipsburg), as well as by Mailcrafter (Inserco model), Pitney Bowes (AMOS model), EMC Document Systems (Conquest Lsi model) and HM Surchin (Cornish model). A rotary variation is made by Buhrs (BB300 and BB 500) series. One more-specific example is the Bell & Howell Imperial™.

Most inserters cycle at least 10,000 per hour without any material. However, once the various hopper materials are inserted into the envelopes, the net production is significantly slower. Due to paper handling problems, swing-arm inserters often net less than one third of their capabilities. A typical swing-arm device in production may net less than 3000 completed envelopes per hour. After careful study, it is now recognized that there are several issues of unreliability in the feeding of materials in conventional inserter devices. Many device areas are subject to jams. In fact, the design of these inserters has not changed significantly in 30 years. And for that matter, they have changed little since their invention 70 years ago, as exemplified by U.S. Pat. No. 2,325,455.

A number of inefficiencies and disadvantages have been noted in prior art swing arm inserters, for example, the overlying swing-arm structure of the inserter is complicated and difficult to access owing to a large number of interconnecting shafts that drive the various arm and gripper components. These shafts require a complicated series of adjustments and tuning to insure proper function. They also obscure access to, and view of, the contents feed hoppers, and more generally interfere with the operator's loading, unloading and operation of the device. In addition, the operative mechanism of the prior art inserter resides beneath a heavy feed table, which is only accessible from beneath. Repair and service of the mechanism is therefore inconvenient and requires the service person to stoop and crawl beneath the device for even the most basic tasks. Other aspects of prior art inserters are similarly deficient. For example, adjusting the size of an envelope in the envelope feed hopper requires adjustments to several elements on the downstream feed table. This is because the upstream end of the envelope hopper is fixed, while the downstream end must be moved, and this causes the synchronization of contents feed components with the envelope leading edge to change whenever the size is readjusted. Likewise, the inserter is constructed with a housing and table that are placed at an average height for an average worker with no easy way to change that height to accommodate shorter or taller operators. Also, while prior art inserters may contain a facility for dealing with the exhaustion or jamming of a "primary" contents hopper by providing a backup, or secondary contents hopper, such backup implementations are non-intuitive and difficult for an operator to implement.

Moreover, prior art inserters generally lack straightforward design in their individual components and power-transmission, making them more expensive to manufacture, more difficult to repair, and more prone to misfeed, due to bad tuning (given the many interconnected parts, which must interact perfectly).

Accordingly, it is highly desirable to provide an inventive high-speed envelope inserter, which intelligently addresses a variety of the foregoing concerns and thereby provides a more-serviceable, faster-running and generally more-reliable device.

SUMMARY OF THE INVENTION

This invention overcomes the disadvantages of the prior are by providing a system and method for inserting contents into envelopes that generally reduces the number of operative device components, locates all components in a readily and accessible location, reduces the number of adjustments needed to change envelope size and contents size, provides an efficient and aesthetically pleasing design, allows for a highly flexible arrangement of backup hoppers to primary hoppers for feeding envelope contents and otherwise affords a substantial number of improvements over currently available envelope inserters.

According to an illustrative embodiment, the device includes a "low-slung" swing arm design with a plurality of grippers for retrieving contents from hoppers and depositing contents on a moving raceway. The low-slung design employs a moving beam and a pair of opposing arms that are secured in a pivoting relation to a pair of respective uprights. This includes closely fitted shims so as to maintain a high degree of parallelism within the structure. This low-slung design insures that the area above the arm is relatively free of any inconvenient components that interfere, obstruct or hinder an operator's loading of the hoppers, or obscure his or her view of the hoppers' contents. The contents hoppers include back and side supports that are easily adjustable and/or removable, and the entire working surface or table top, when removing the envelope hopper as well, can be pivoted into an inverted position with the swing arm extending into the volume of the underlying device housing. In this pivoted-open position, the moving/operative components of the device are fully exposed to the user at waist level for extremely easy inspection and servicing.

In an illustrative embodiment, device components are powered by a central drive motor that is attached to the underside of the feed table. Three shafts power all the components. One of the shafts is a continuously rotating shaft that powers elements requiring continuous motion. An interconnected shaft includes an indexer to provide intermittent motion to power, for example, the contents raceway belt. A third shaft arranged on an axis perpendicular to the first two shafts (fixed and intermittent) powers the swing arm and envelope inserter components. All shafts and their respective power take-offs are mounted on the underside of the table and readily accessible.

In an embodiment of the invention, the front face of the housing includes a concave panel that is aesthetically pleasing and also provides additional clearance for an operator's knees, etc. A further embodiment of this invention provides other desirable features such as moveable feet that allow the height of the housing to be raised and lowered to suit an operator. These feet can be electrically (or otherwise) powered in an embodiment of the invention. In addition, the device includes an elevated control panel with a highly intuitive control-switch-and-status-light display. The control switches include particular controls for activating/deactivating each of the contents hoppers and allowing adjustment contents hoppers to be designated as backups to a given primary hopper. In this manner, the device can be run continuously as each hopper is emptied in turn. The novel raceway belt having timing belt teeth driven by drive and follower sprockets, transports contents downstream to the insertion area and includes spaced-apart lugs that grasp trailing edges of contents and carry them forward, in the downstream direction. These lugs are attached through the belt with through-fasteners and respective backing plates that substitute for one of the timing belt teeth. The backing plates have a slightly smaller dimension than the timing belt teeth so as to avoid damage to drive sprockets.

In a further embodiment, the swing arm includes easily accessible internal fasteners that allow for quick removal and/or reconfiguration of individual contents grippers. Each of the contents grippers are driven by a common camshaft that operates to opening and close the grippers at opposing ends of the swing arm arc. Each opposing end of the swing arm arc, respectably, picks up contents from a hopper and deposits the contents onto the raceway. In a further embodiment, the insertion area of the device can include a not-moving table section that avoids many of the needed readjustments common to currently available envelope inserters. This non-moving table section allows for easy adjustment of the device to accommodate different-width envelopes. It relies upon a movable envelope leading edge (downstream) hopper guide plate and a clamp bar having a nip that can be adjusted in an upstream-to-downstream direction so that envelopes enter the constant-cycle envelope drive belt at an appropriate time to ensure proper registration with a downstream contents transfer and stuffing station.

BRIEF DESCRIPTION OF THE DRAWINGS

The invention description below refers to the accompanying drawings, of which.

DETAILED DESCRIPTION

Figure 1:
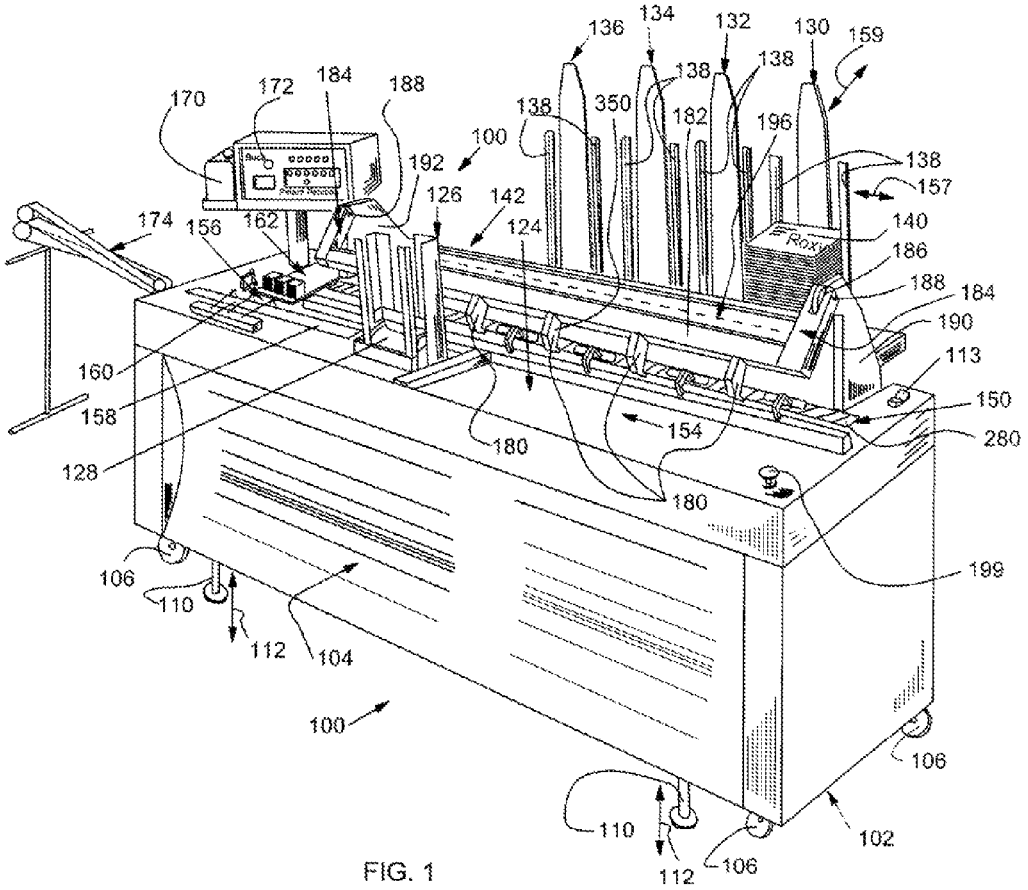
FIG. 1 is a perspective view showing a general overview of a high-speed envelope inserter according to an illustrative embodiment of this invention.

A system for inserting contents into envelopes 100 is shown in FIG. 1. In overview, the system 100 (also termed herein generally as the "inserter" or "device") includes a main housing 102 having a concave front panel 104 that particularly aids workers in gaining closer access to the device (with room for knees), and also provides a unique, pleasing appearance to the device housing 102.

The housing 102 is supported on at least four heavy duty caster wheels 106 that provide portability. In general the housing 102 is a relatively lightweight structure consisting of an internal framework (not shown) and removable covering panels that allow access to the device's interior (as an alternative to the flipping-table system described below). The caster wheels 106 are supplemented by at least four (located adjacent each of the four caster wheels) retractable feet 110 that resist sliding, once deployed. The feet move up and down (double arrows 112) based upon a manual or automated drive system (a screw drive for example). This drive system allows the elevation of the housing 102 to be raised and lowered to accommodate different-height users. An up/down switch 113 can be located at a convenient position on the housing 102 to facilitate upward and downward movement. The top side of the housing 102 includes the working surface or table 124. This table surface 124 is constructed from a casting of aluminum in this embodiment, although it can be constructed from sheet and/or plate components in alternate embodiments.

The illustrative table surface 124 contains all of the exposed components needed to insert predetermined contents into envelopes. The envelopes 128 are stored in a stacking hopper 126. In alternate embodiments, a cartridge that includes envelopes can be provided. Such a feeding system is shown and described in U.S. Pat. No. 6,663,100 entitled "SYSTEM AND METHOD FOR SUPPLYING STACKED MATERIAL TO A UTILIZATION DEVICE," by H. W. Crowley, the teachings of which are expressly incorporated herein by reference. Contents, which comprise folded, or otherwise appropriately dimensioned, documents that are sized to be inserted into envelopes 128 within the hopper 126, are stored in a series of contents hoppers defined by removable and adjustable back guides 130, 132, 134 and 136. Each depicted back guide represents a feed station for selected contents. Pairs of removable side guides 138 define the upstream and downstream widthwise edges of each content feed hopper. An exemplary set of contents 140 are shown stacked with respect to the first back guide 130. In this embodiment, two additional content feed stations/hoppers can be provided in the open area 142 residing downstream of the back guides 130-136. The side guides 138 are each removably attached to the underlying bar by pinch clamps and turn screws (not shown) of relatively conventional design. They can be slid (double arrows 157) along the bar and secured in place to define the appropriate upstream-to-downstream width for a respective stack of contents.

As used herein, the terms "upstream" and "downstream" refer to the flow of both contents and envelopes through the device. The upstream end 150 is at the beginning of a contents raceway that is defined by a moving, continuous transport belt 280. The belt 280 moves downstream in the direction of arrow 154 until all contents on the raceway are presented to an insertion area 156. Envelopes 128 are driven in succession into the insertion area 156 from the envelope hopper 126 along a continuous feeding belt 158. A series of pickers 160 and pusher fingers that are part of a contents-insertion transfer station 162 (described further below) urge the envelope into a flap-open position while retrieving, in turn, the now-stacked contents from the raceway, and driving these contents pieces through the flap opening on the envelope. A wetting system, which is fed by a reservoir 170 in an elevated control panel 172, is used to wet the adhesive on the envelope flaps so that they may be sealed. In this embodiment, the now-sealed envelopes are passed from the station 162 through a twisting belt arrangement 174 to a final, downstream location where they are boxed, stacked, or otherwise accumulated.

According to a novel feature of the device 100, contents are drawn from respective stacks using cam-actuated grippers 180. The grippers 180 are mounted at the end of a swinging bar or beam 182 that swings, pendulum-like, through a predetermined arc between one end position adjacent to the raceway and an opposing end position adjacent to the contents stacks. The bar or beam 182 swings on the end of each of two durable (aluminum in this example) arms 184 at each or the opposing ends of the beam 182. The arms 184 each include clevis assemblies 186 with pivot pins 188 that pass through each of a pair of overhanging uprights 190 and 192 that are fixed to the table 124.

The swinging arm and beam components will now be described in further detail with reference to FIG. 2. Various components associated with the device's top surface 124 have been omitted for clarity. For example, only the upstream-most and downstream-most grippers 180 are shown. As will be described below, grippers 180 can be removed easily from the beam 182 as needed for service or reconfiguration of the device. The beam 182 is constructed from aluminum, steel or another durable material in the form of a channel member 210 with an overlying, removable access cap 212. The specific arrangement of parts to define the beam is widely variable. The cap 212 is attached by a series of bolts or other removable fasteners 214 in this embodiment. Again, a variety of attachment mechanisms can be employed. As described above, each of the opposing ends of the beam 182 are attached to a respective swing arm 184. In this embodiment, the swing arm 184 is constructed from bar stock or another solid material with a lower portion attached to the beam and an upper clevis portion 186 that is split into side-by-side wings 220 with a central slot 222. The central slot 222 is sized and arranged to closely conform to the width WA of each upright 190 and 192. The respective pivots 188 are also relatively closely conformed to both the upright and the clevis 186. This arrangement results in each swing arm 184 being maintained at conforming right angles to the uprights 190 and 192 so that minimal twist, or other unwanted non-parallel movement, occurs as the arm swings (double curved arrow 230) about the axis of each pivot 188.

In general, the tolerance of each swing arm slot 222 with respect to the width WA of the upright is in a general range of two to five thousands of an inch in order to obtain desired parallelism throughout the arc of swing. In an illustrative embodiment, such close tolerances can be obtained by inserting shims of a given thickness along the pivot between the upright and the clevis. In this manner, the actual slot width can be significantly wider than the width WA of the upright to a count for variability in these dimensions. An appropriate-thickness shim 240, 242 (shaped as an annular washer in this example) is then inserted on each side of each upright between the clevis wing and the upright.

The downstream swing arm (184) is interconnected at the pivot point 188 to a drive arm 250 that is fixed by fasteners 252 to the clevis wing 220. This drive arm 250 is a rigid beam with an opposing end 254 that rides on a pivot 255, which is, in turn, attached to a drive wheel 256. The drive wheel 256 is mounted on a keyed (or otherwise rotationally filed—e.g. splined) shaft 258 that communicates with a drive motor system so that the rotation (curved arrow 260) of the drive wheel 256 is translated into a rocking motion within the arm 250 about the pivot 188. The degree of eccentricity on the wheel 256 between the shaft 258 and drive arm's pivot 255 dictates the resulting arc (double-curved arrow 230) through which the beam 182 swings. This arc can be adjustable, but is typically a fixed degree value. The degree of the arc should be sufficient to allow the grippers 180 to transition between a location on the raceway and a location in which they engage the bottom sheet in each contents stack.

It should be clear that the use of uprights and a swinging beam with high parallelism allows the upper region of the device to be essentially free of interfering components, secondary drive shafts and other items that complicate the device and can interfere with the operator's ability to properly load, unload and operate the device. In addition, the open and "low-slung" arrangement of the swinging beam and uprights facilitates its easy viewing and convenient loading access to each of the contents bins. This aids workers in monitoring when contents are about to become exhausted from a given bin. As discussed above, envelope inserters according to prior art arrangements include a plurality of such overhanging rods, interconnections, and the like. The novel arrangement of this invention effectively eliminates such features.

Figure 2:
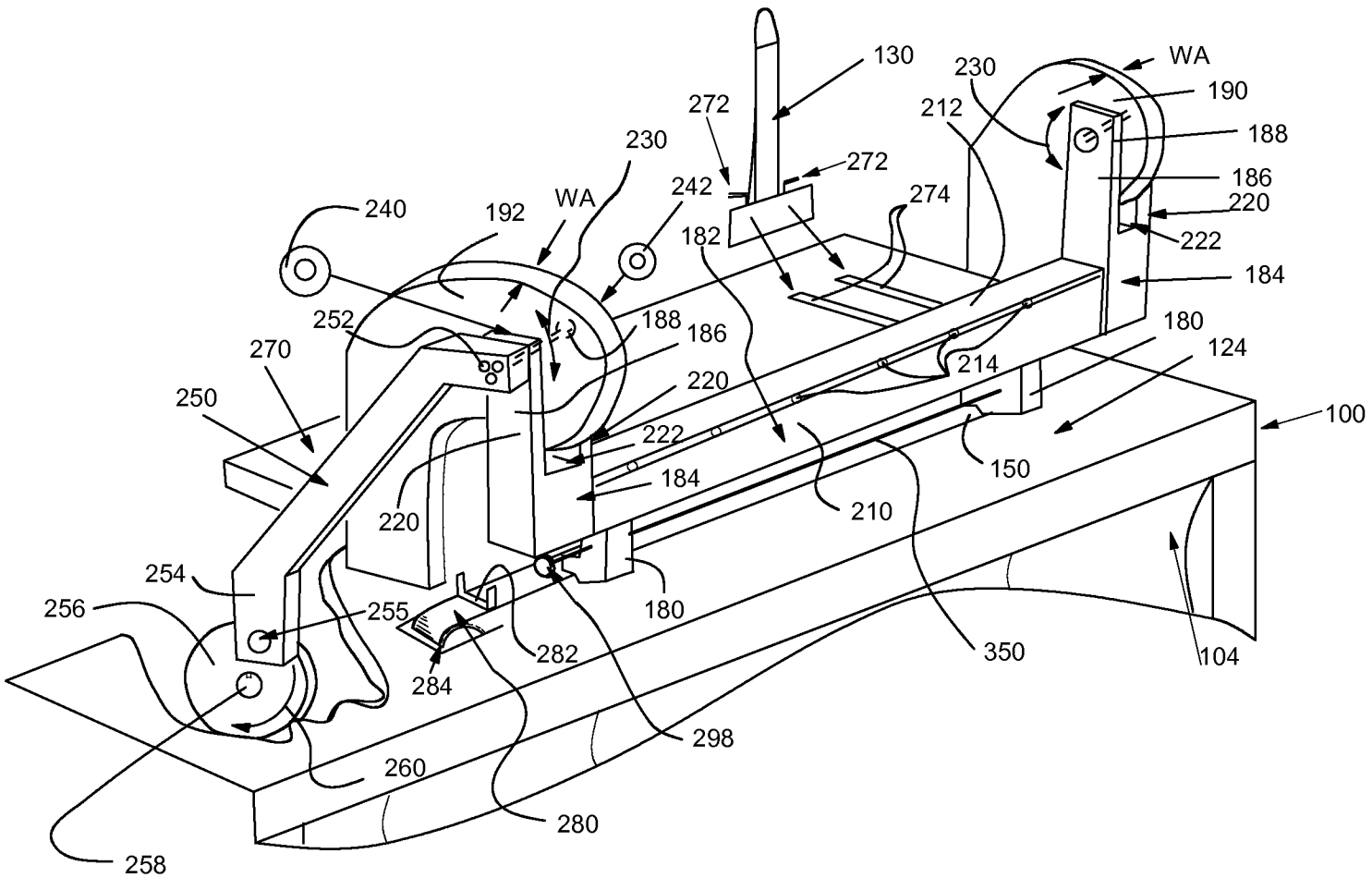
FIG. 2 is a more-detailed partial perspective view of the envelope feed table surface for the inserter of FIG. 1 featuring a "low-slung" swing arm design in accordance with an illustrative embodiment.

As further shown in FIG. 2, the contents feed hopper back guide 130 (etc.) can be quickly removed from the rear support table 270 by turning a pair of handles 272 that selectively engage and disengage respective key slots 274 with corresponding locking cams (not shown) that can comprise a conventional implementation. The slots 274 are oriented with elongation perpendicular to the upstream-downstream direction. This allows the width of contents within a given hopper to be varied by sliding (double arrow 159 in FIG. 1) the back guide (exemplary guide 130 in this example) along the slots 274 to the appropriate location, and then locking the handles 272. The sliding, adjustable back guides act in concert with the adjustable-width side guides 138 described briefly above. The side guides 138 are mounted to a rail 196 (see also FIG. 12 further detail) for that is positioned behind the swinging beam 182, and between the two uprights 190 and 192. The rail is omitted from the view in FIG. 2 for clarity, but is shown in FIG. 1. The rail 196 also supports movable vacuum suckers that selectively engage the bottom sheet in each stack of contents, and allow its leading edge to be spaced downwardly from the upper sheets in the stack so as to enable a respective gripper 180 to engage the contents sheet when the beam attains the rearmost end of the arc. The structure and operation of a novel sucker assembly is described in the above-incorporated U.S. Pat. No. 6,698,748, entitled SYSTEM AND METHOD FOR SINGULATING A STACK OF SHEET-LIKE MATERIALS, by H. W. Crowley.

The contents pieces (140) are moved downstream along the raceway 150 on a belt 280. Briefly, the belt 280 includes spaced-apart lugs 282 that project upwardly from the otherwise relatively smooth surface of the belt. The belt resides within a trough or slot 284 formed within the table top 124. The underside of the belt 280 (described further below) includes a set of spaced-apart teeth, in the manner of a timing belt. These teeth engage corresponding sprocket teeth on a drive and follower roller on each of opposing upstream and downstream ends of the belt's run on the raceway 150. Certain teeth are removed or shortened to accommodate a backing plate that secures a given lug 282 to the belt 280 using fasteners, adhesives and/or other attachment systems. The lugs 282 can be constructed from a durable medal, plastic or another material.

Figure 3:
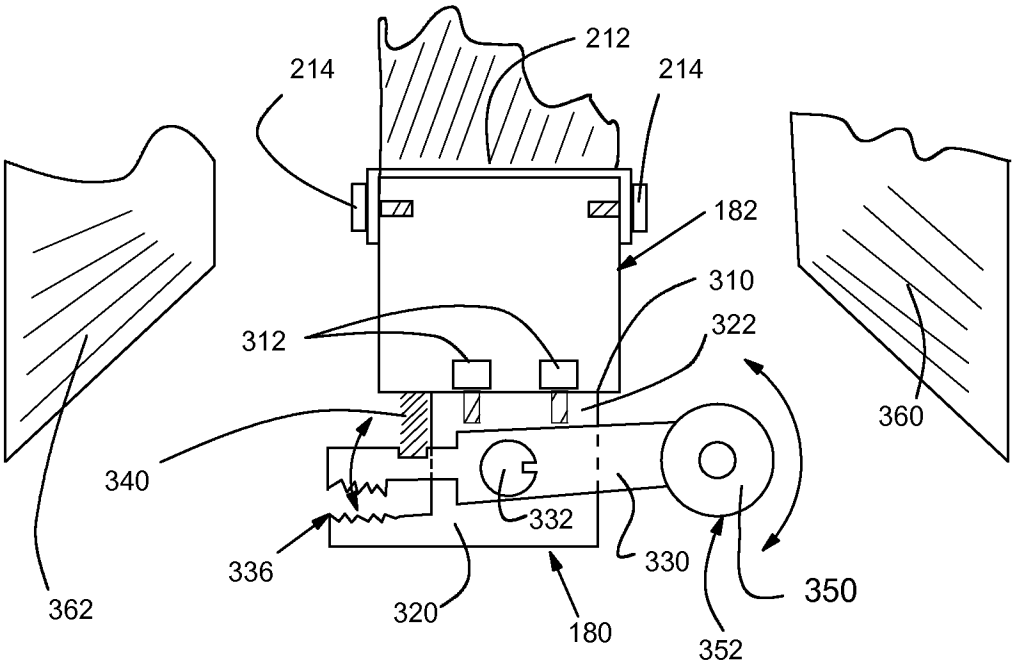
FIG. 3 is a side cross-section of the swing arm beam and removable gripper assembly according to an illustrative embodiment.

Significant economy of moving components is achieved by the gripper assemblies 180 of this embodiment. With further reference to FIG. 3, each gripper 180 is secured to the bottom side 310 of the beam 182 by (in this example) threaded fasteners 312. A variety of attachment mechanisms are contemplated in alternate embodiments. The gripper 180 consists of a lower jaw 320 that is fixed by an upper base 322 to the beam 182. The movable upper jaw 330 is attached by a pivot 332 to the base 322. The lower and upper jaws 320, 330 together define a movable pincer 336 that pivots between a gripping position and an open position. The pincer jaw is normally biased closed by a compression spring 340 so that varying thicknesses of contents can be accommodated with a relatively constant gripping pressure provided by the spring. During the midcourse of the arc, as shown in FIG. 3, the pincers are normally in a sprung-closed position (herein instead shown opened against the spring bias for clarity). A common cam bar 350 interconnects the tail end of each upper jaw 330 of each gripper 180 along the beam. A cam trip assembly 352 at the downstream end 298 (shown in FIG. 2) comes into engagement with a pair of ramps 360 and 362 located with respect to each of opposing ends of the beam's swing arc. Thus, when the cam trip 352 and interconnected cam bar 350 move adjacent to the raceway belt 280, the cam trip 352 and bar 350 thereby come into engagement with the ramp 360 and cause the gripper jaws 320, 330 to open, which deposits any gripped contents onto the raceway belt 280. Similarly, when the beam 182 swings toward the contents hoppers, the ramp 362 engages the trip 352 and interconnected cam bar 350, thereby causing the gripper jaws 320, 330 to open so as to enable gripping of the plucked bottom contents of the contents hopper stack (140 in FIG. 1). In an illustrative embodiment, the ramp 362 can include a latching mechanism that causes a sudden snap-closure of the jaws to occur as the beam withdraws from its rear most position, thereby ensuring that the contents are firmly gripped before the grippers pass out of an overlapping orientation with the contents. Such a latching mechanism can be implemented in accordance with conventional mechanical design techniques, and is not further described.

Figure 4:
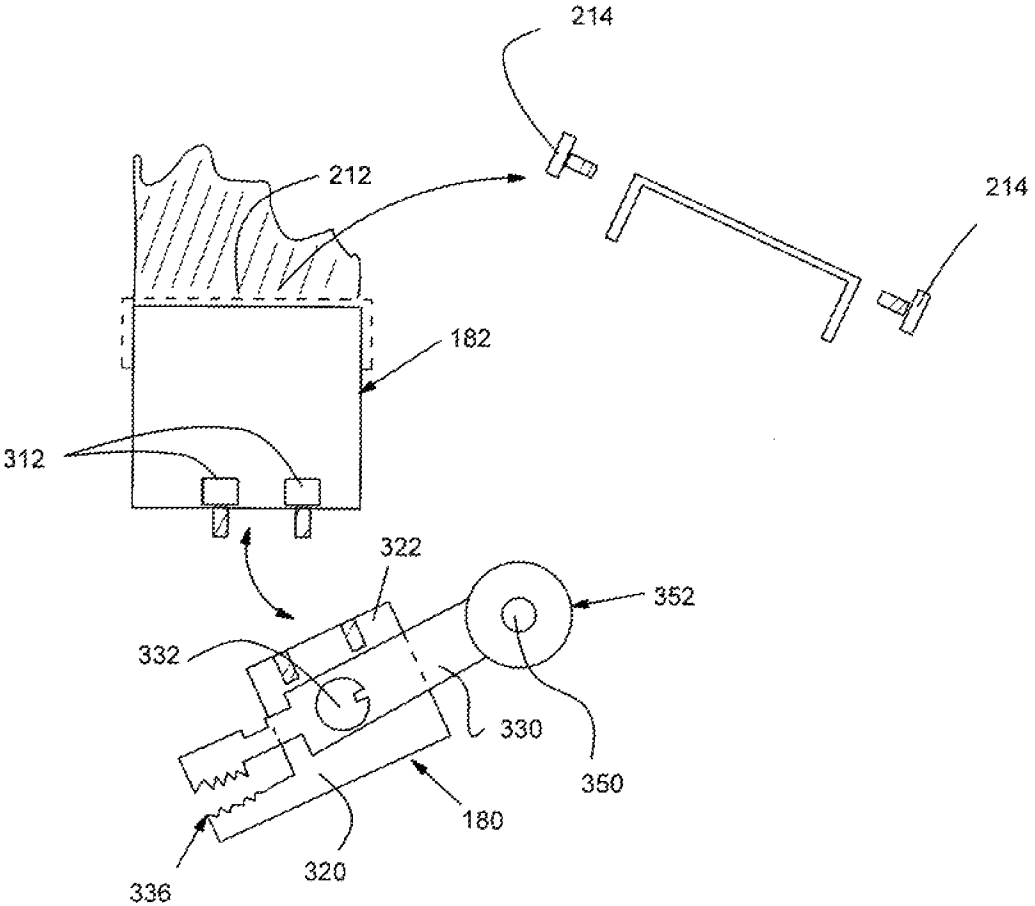
FIG. 4 is a side cross-section of the swing arm beam and removable gripper assembly showing the gripper assembly removed.

As shown in FIG. 4, one or more gripper assemblies 180 can be readily removed for servicing, replacement or reconfiguration of the device (i.e. changing the number and positioning of contents hoppers) by removing the top cap 212 of the beam 182, or otherwise (for example through access holes) gaining access to the interior of the channel portion of the beam so that the gripper base fasteners 312 can be backed out, or otherwise disengaged. As such, the base 322 of the gripper assembly 180 is detached from the bottom side 310 of the beam 182. In one embodiment, the cam bar 350 is a continuous rod that is connected through all of the grippers. The upper jaw 336 can be adapted to allow detachment from the bar 350. Conversely, the bar can be segmented, with the bar segments between each of the grippers being attached using a conventional coupling—for example, an Oldham coupling. Alternately, grippers may simply be slid off by moving them down the (one-piece) bar 350 and off of (for example) the upstream end once the grippers are all detached from the beam 182. Other forms of attachment mechanism that allow for entirely external attachment and detachment of gripper assemblies 180 can also be employed in alternate embodiments.

Figure 5:
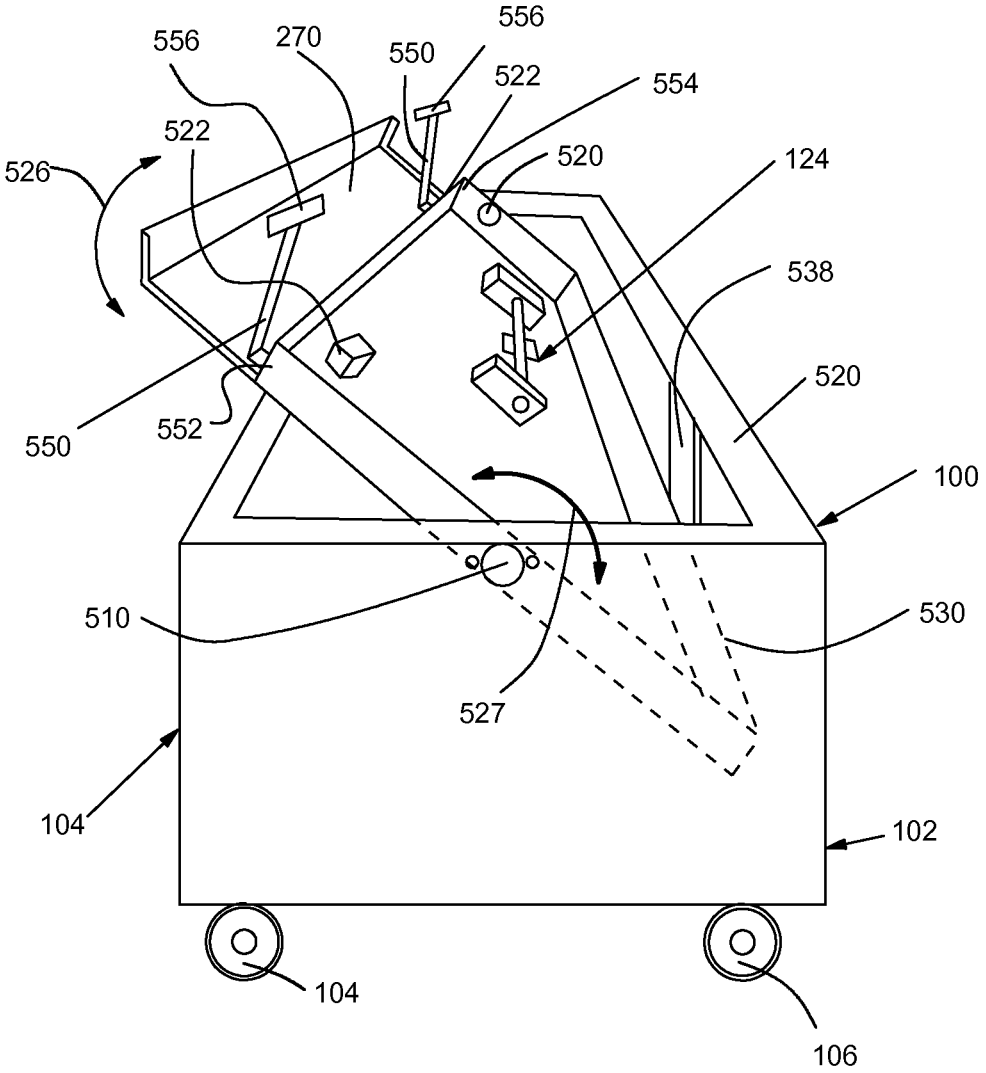
FIG. 5 is a partially exposed side perspective view of the inserter feed table being rotated so as to access the operative mechanism along the underside thereof.

The above-described low-slung design, in combination with other efficient implementations of device components allows for highly useful and novel arrangement for accessing the various moving mechanisms of the device. As shown in FIG. 5, the table top 124 can be rotated (double curved arrow 527) almost 180 degrees (135-145 degrees as shown) to expose most of the essential operative components of the device. As further shown, the table top 124, and the interconnected rear contents-hopper-supporting surface 270 is rotated (curved arrow 526) about a pair of opposing pivots 510 and 520 into the depicted exposed position. In this position, the rear contents hopper support surface 270 moves from its original position overlying the rear frame rail 520 to an upside down orientation, suspended over the front face 104 of the housing 102. Note that before rotating the table assembly, the user need only remove the envelope feed hopper 128 and each of the contents back guides 130, 132, 134, 136, and corresponding back guides 138, so that these components do not interfere with the rotational motion. The front side (edge 530) of the main tabletop 124 is submerged within the open volume of the housing 102 as shown. The table 124 and rear surface 270 are balanced with respect to the pivots 510 and 520 so that very little force is required to rotate the assembly. In general, the top's weighting favors the depicted open position so that releasing the hold-downs 556 (described below) causes the table to gently rotate open. The pivoted opening of the table top 124 is limited the where the front edge 530 of the table top 124 engages a small bumper (not shown) on an upright frame member(s) 538 within the interior of the housing 102. A variety of rotation-limiting, or stopper, mechanisms can be employed in alternate embodiments to restrict the degree of rotation of the table top 124 into the inverted orientation whereby components are exposed.

Figure 6:
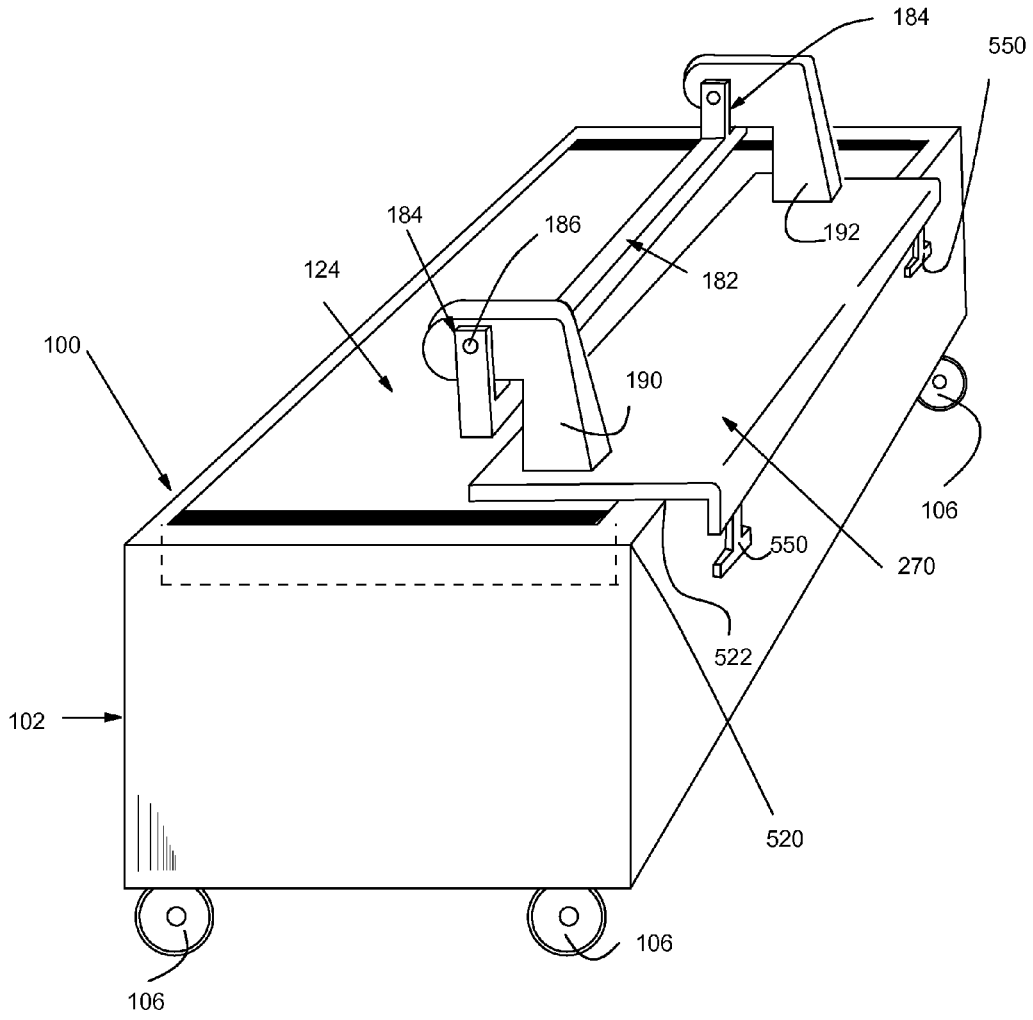
FIG. 6 is a partially exposed side perspective view of the inserter feed table of FIG. 5 shown secured in an upright orientation, ready for operation.

As further illustrated in FIGS. 5 and 6, all, or a vast majority, of the operative mechanism of the device is mounted to the bottom side of the table 124 and adjoining surface 270. That is, drive motors, drive rods, raceway components, pneumatic circuits and electrical circuits can be largely provided within the underside of the table and made easily accessible. In one embodiment, the table is constructed as a solid casting with appropriate cutouts and strengthening ribs. The surface 270 can be a sheet metal plate mounted on ribs that extend from the table 124. It should be clear that a variety of table and surface structures can be employed in alternate embodiments. While not shown, certain components such as pumps, lifting mechanisms and power distribution components can be provided within the roomy volume of the housing, generally off to one side—such as at the downstream rear corner beneath the control panel 172.

Securing the table top 124 and rear contents hopper supporting surface 270 to the underlying housing is relatively simple. A pair of elastomeric, T-shaped hold-downs 550, which can be a conventional design, are attached to each of opposing end ribs 552 and 554 on the table. These ribs 552 and 554 can also be employed to secure part of the surface 270 to the table 124. The hold downs each include a hole or other locking structure adjacent to the T-shaped end 556. As shown in FIG. 6, when the table assembly is forcibly pivoted into a closed orientation by the operator, each of the T-shaped hold downs is tensioned so that the hole passes over a fixed post or other locking base (not shown) secured to the rear side of the housing 102. Typically, each post is secured on a plate (not-shown) attached to an upright frame member within the housing. A pair of feet or cushions 522 (see also FIG. 5) are provided on the bottom side of the overlying supporting surface 270 to prevent damage. It should be noted that a variety of securing mechanisms can be used in alternate embodiments. In addition, while the rotation of the table assembly is performed manually in this embodiment, hydraulic, numeric and/or electromechanical systems can be employed to rotate the table assembly and/or to lock it in place. In a further alternate embodiment, gas springs or other damping mechanisms can be used to slow the opening of the device. Such damping mechanisms can be rotary dampers that act in conjunction with the pivot or linear dampers that are attached to appropriate portions of the table assembly and to the housing.

It should also be clear that the above-described arrangement for allowing easy access to most, or all, moving device components provides a substantial improvement over prior art devices. Such prior art devices typically require removing of one or more panels on the housing to access permanently fixed components therein. A large number of interconnecting gears, pushrods, links and other members are provided between the elements in the housing and the exposed elements on the table assembly in such prior art arrangements. Hence, these prior art arrangement make the servicing of the device more uncomfortable for the maintenance worker, as significant time must be spent stooping down, and working in uncomfortable orientations beneath the device.

Figure 7:
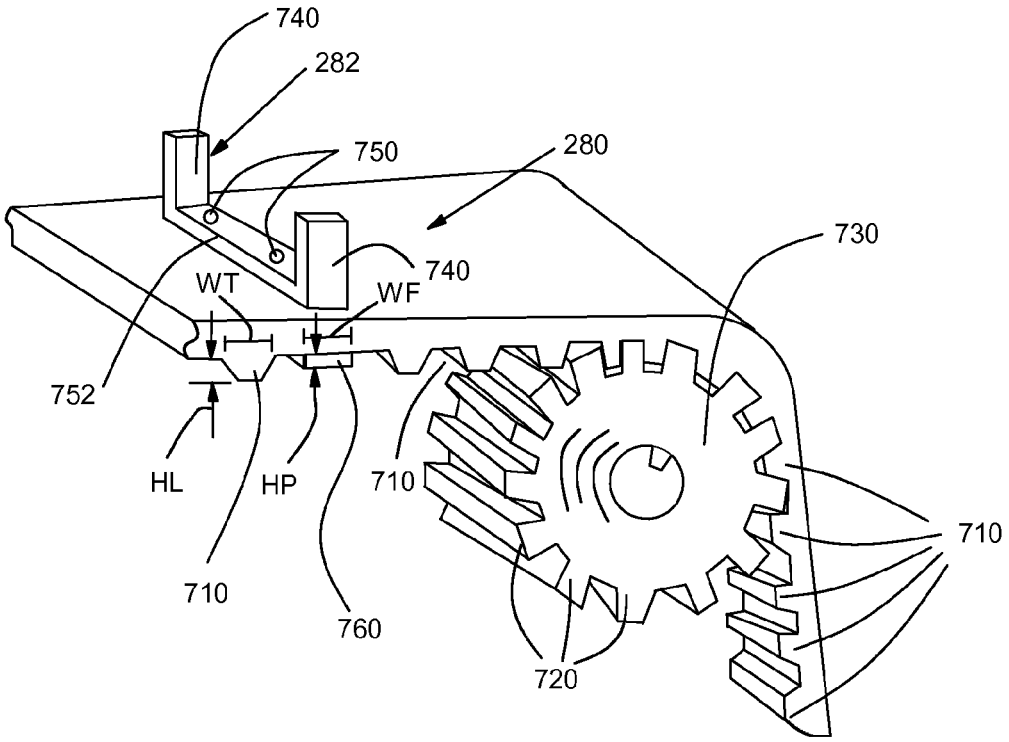
FIG. 7 is a fragmentary perspective view of the contents raceway conveyor belt and associated drive sprocket including an inventive pushing lug assembly according to an illustrative embodiment.

As described above, the raceway's contents transport belt 280 includes a plurality of regularly spaced lugs 282 that are located at spacing distances that are sufficient to span the width of the maximum-width (upstream-to-downstream width) contents expected to be presented to the system 100. As shown further in FIG. 7, in this embodiment, the belt 280 is constructed with a series of regularly-spaced timing-belt grooves 710 that are adapted to engage corresponding teeth 720 on a drive sprocket 730, and an opposing, similarly shaped follower sprocket (not shown). The drive and follower sprockets maintain the registration of the lugs 282 as they move along the raceway with the drive sprocket 730 being part of the overall central drive motor system (not shown). The lugs 282 are provided to the continuous belt 280 using a novel technique. Each tooth 710 on the belt has an average height HL as adapted to conform to the teeth 720. Since the belt is elastomeric, its teeth will not generally mar the teeth of the sprocket, thereby assuring the sprocket a long life. However, the lugs present a concern in that securing them to the top of the belt requires a stiffener plate 760 on the opposing side of this embodiment. The stiffener plate 760 is adapted to reduce the risk of marring of the sprocket teeth 720 because the plate 760 defines a width WP that is narrower by several thousandths of an inch than the maximum WT of a standard belt tooth. Likewise, the height HP of the plate 760 is less by several thousandths (or more) of an inch than the maximum height HL of a conventional tooth. It has been determined through observation that, for a sprocket having a diameter of at least two to three inches, the adjacent teeth 710 to the plate 760 maintain sufficient contact with the sprocket teeth so that the plate never digs into a sprocket tooth 720. In this manner, the lug is effectively secured (by through-fasteners, such as rivets 750) to the top of the belt 280

In this embodiment, the lug 282 also includes a pair of opposing, upright, outer wings 740 having a height of approximately three-sixteenths to five-sixteenths of an inch in this embodiment. The center region of the lug 282 between the wings 740 consists of a shorter-height plate 752, through which the fasteners 750 pass. Various different lug geometries are expressly contemplated according to other implementations, each with the goal of urging contents deposited by grippers downstream to the collection and insertion area of the device. Likewise, the technique for attaching a lug to a belt is widely variable and the depicted technique is one of a variety of possible attachment techniques.

Figure 8:
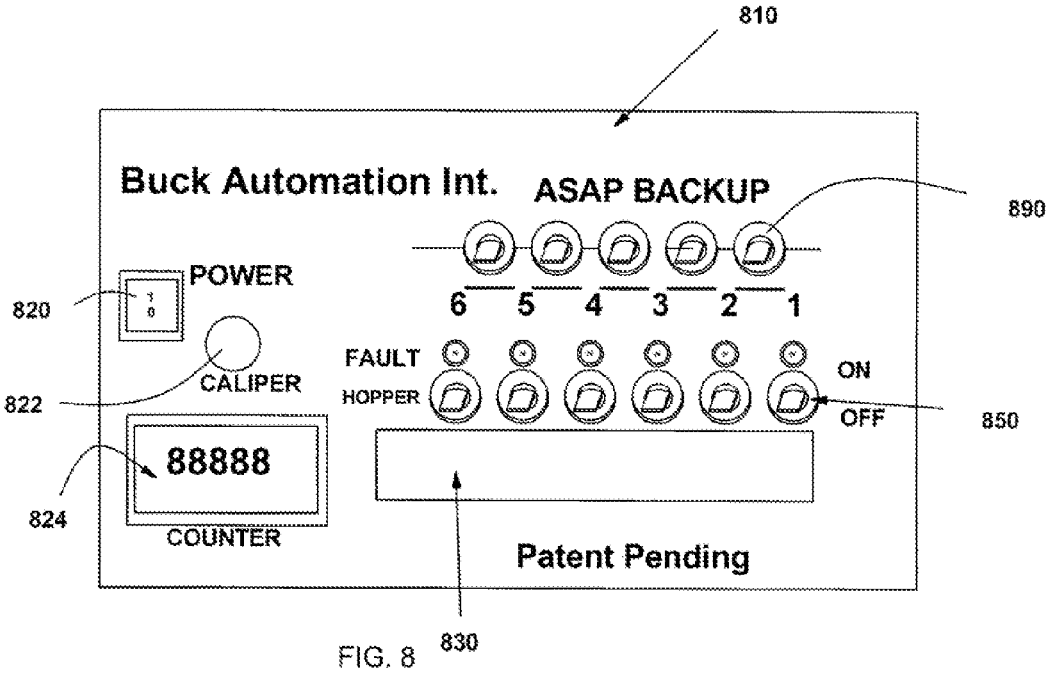
FIG. 8 is a plan view of an illustrative control panel arrangement for the inserter of FIG. 1.

FIG. 8 shows an exemplary control panel face 810 that resides on the front of the suspended control console 172 (FIG. 1), according to an illustrative embodiment. The control panel 810 includes a conventional power switch for activating the device. Emergency stop switches, circuit breakers and other operation-interlock/safety mechanisms (for example, the kill device-operation button 199 on the table 124 in FIG. 1) can be placed at convenient locations on the device housing 102. In addition, there is a caliper switch 822 that allows for the setting of the grippers' set-point to match a given standard-thickness sample of the contents to-be-inserted. The panel also includes an envelope counter readout 824. A variety of fault and jam detectors, which operate based upon inputs from grippers and other system components, are provided in the window 830 of the panel 810. These and other components of the device's control system can be run using a microcontroller, microprocessor, and/or state device logic as appropriate. In an illustrative embodiment, a microprocessor of appropriate size and processing speed is employed along with an associated memory (neither being shown).

Notably, the control panel 810 includes an array of six hopper "on-off" switches 850, 852, 854, 856, 858 and 860 (denoted as Hoppers 1-6, respectively, in an downstream-most to upstream-most arrangement). When a given on-off switch is shifted from the "off" to "on" position, the vacuum valve for a given contents-hopper sucker is activated. This operational vacuum enables the bottommost piece to be drawn downwardly so that it is aligned to engage the swinging gripper for the selected contents hopper. When the vacuum is switched off, the gripper misses the bottommost piece at the end of its swing-arc, and the bottom contents piece is not drawn. Note that when a hopper is switch on, the gripper looks for an appropriate thickness (caliper) of contents to be provided thereto. An electro-optical or resistance-based sensor within each gripper assembly determines when the gripper jaw has deflected due to the presence of a contents piece. When an appropriate degree of deflection has occurred, then the system is signaled that a contents piece is present. A variety of conventional electromechanical and/or electro-optical detectors can be employed in this arrangement. If contents pieces are not gripped, or more than one contents pieces are gripped by the grippers, then a fault light 870, 872, 874, 876, 878 and 880 is indicated for the respective hopper (Hoppers 1-6, respectively).

Figure 9:
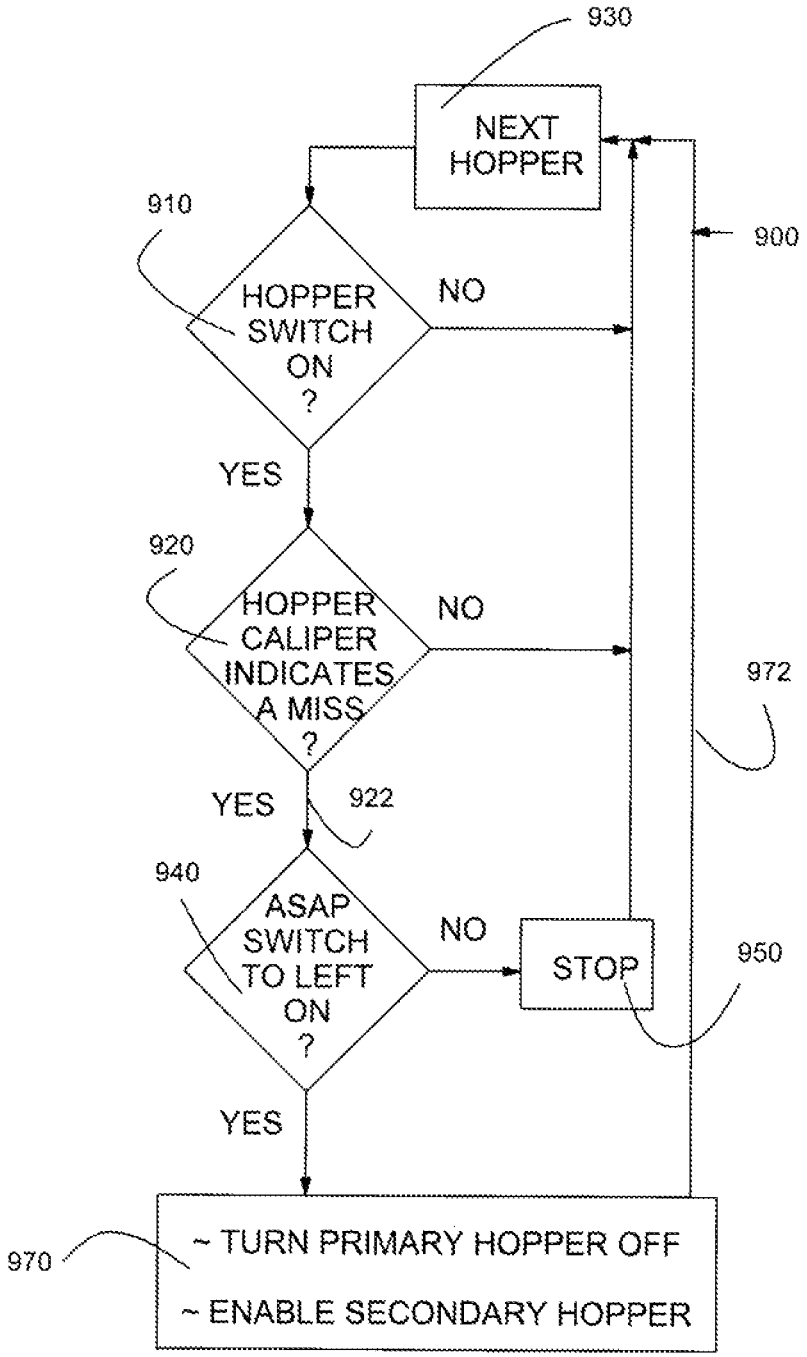
FIG. 9 is a flow diagram of procedure for switching from primary to secondary, backup contents feed hoppers according to an illustrative embodiment.

Referring now to the flow diagram of FIG. 9, the system "ASAP" procedure 900 checks the status of each hopper. If a hopper is switched on (decision step 910), then the system procedure 900 determines whether the hopper's gripper caliper (e.g. degree of opening) indicates a fault or miss (decision step 920). If hopper is not toggled on, or no miss is determined, then the system procedure moves to the next hopper (step 930). If, however, a miss/fault in gripping a contents piece is indicated for an activated hopper, then the system procedure branches to decision step 940. With reference also to FIG. 8, the control 810 includes five backup switches 890, 892, 894, 896 and 898 that overlie the associated indicia for each hopper (e.g. 1-6). The back up switches can be toggled between off and on. When a backup switch is toggled on, it allows the system to automatically switch from a given right-hand hopper to the immediately adjacent left-hand hopper when the right-hand hopper experiences a fault (as indicated by one of the lights 870-880). Hence, in the decision step 940, a misfeed (branch 922 from decision step 920) causes the system to look for a backup switch to the left of that hopper in an on position. If there is no designated backup for that hopper, then the system triggers a stop of the device (step 950). However, if a backup switch to the left of the faulty hopper is toggled on, then the faulty or "primary" hopper is turned off (caliper is no longer scanned, and the vacuum of the sucker is deactivated), and a secondary hopper to the left of that hopper is turned on as shown in step 970. The system then returns via branch 972 to scan the next hopper in step 930. The process continues indefinitely until the job is complete or the device is cycled off. Hence, the backup switches allow automatic switching from a first or primary hopper to a secondary hopper without experiencing a device stoppage. Typically, the right-most hopper (e.g. Hopper 1) on the panel 810 represents the most-downstream hopper. In the example of FIG. 1, the two downstream most hoppers have been disabled and no backing guides are provided thereto. Thus, switches 1 and 2 would be in the off position in that implementation.

Figure 10:
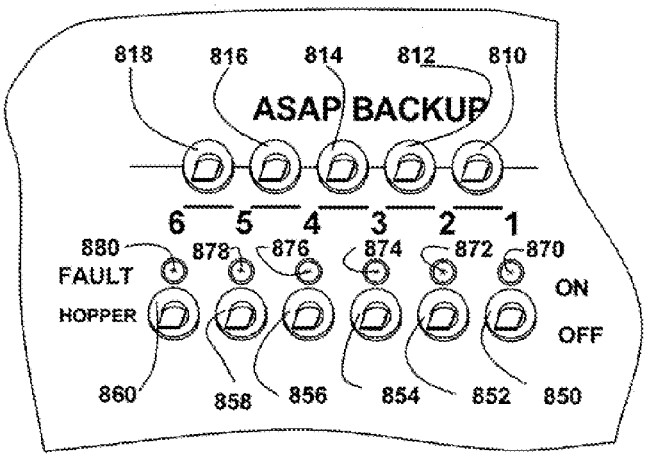
FIG. 10 is a diagram of an exemplary backup hopper setup in accordance with the control panel arrangement of FIG. 8 and the procedure of FIG. 9.

By way of a basic operating example, as shown in FIG. 10, all Hoppers 1-6 (850-860) are switched into the on position—meaning that they are all being used as either a primary contents source or a secondary, backup, contents source. The backup switch 890 between Hopper 1 and Hopper 2 is switched on, meaning that Hopper 2 is a backup to primary Hopper 1. Likewise, the backup switch 892 between Hopper 2 and Hopper 3 are switched on. This means that when Hopper 2 becomes a primary (due to a fault or emptying of Hopper 1), then Hopper 3 becomes a backup to it. However, the backup switch 894 is toggled off. This means that Hopper 3 has no backup, and its fault would cause the system to stop. Since Hopper 4 is activated, it is its own primary source but, the backup switch 896 allows Hopper 5 to become its backup. Since the final backup switch 898 is toggled off Hopper 6 has no backup and operates only as a primary. Again, its fault would cause the system to stop. It should be clear that a large number of variations on the exemplary settings in FIG. 10 can be implemented in accordance with alternate embodiments. For example, where all backup switches 890-898 are toggled on, and all hopper switches 870-880 are toggled on, each hopper will be emptied, and in turn, before the device shuts off. Where all hoppers are filled with the same identical contents pieces, this arrangement allows for an extremely long run-time before hoppers must be refilled with new contents pieces (if at all). Likewise, where some contents pieces are significantly thicker than others, they can be spread among two adjacent hoppers to provide the same number of contents pieces as an adjacent hopper having larger number of thinner contents pieces in its stack. For example, two adjacent hoppers accommodate one hundred thick pieces, fifty each, while the next hopper accommodated one hundred thinner pieces in a single stack.

Typically envelope inserters include functional components (such as the swing arm that require a continuous drive, while other components, such the contents insertion assembly, require an intermittent drive that operates only at particular times relative to the continuous drive—for example, when the contents are all accumulated before an envelope, and ready for insertion. Most prior art inserters employ several different power transmission shafts and bearing points to implement such an arrangement. This increases the machine's cost and complexity and leads to higher maintenance costs and failure rates.

Figure 11:
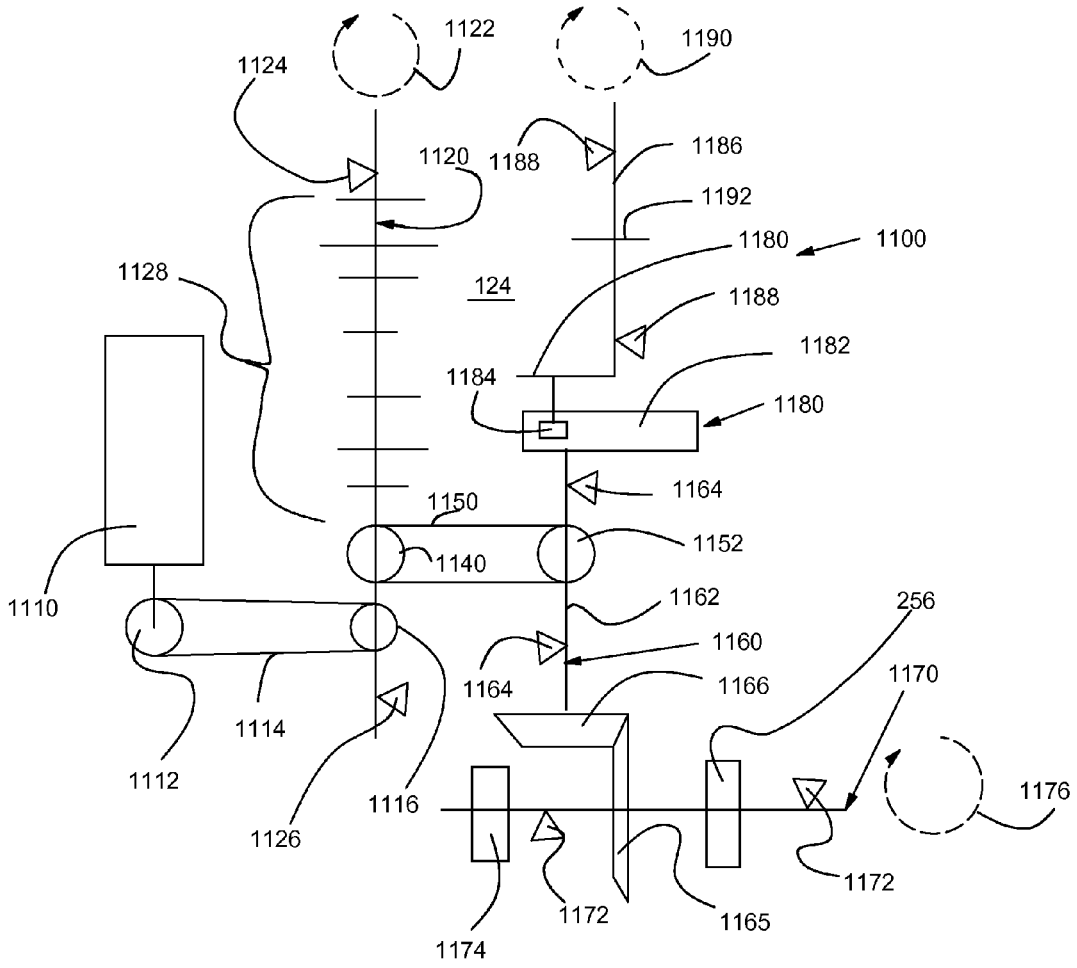
FIG. 11 is a schematic plan view of the general arrangement of continuously driven and intermittently driven power transmission shafts for operating various components of the system according to an illustrative embodiment.

Conversely, the device 100 in the illustrative embodiment includes a novel arrangement of operative components (all of which are mounted on the underside of the table 124, as described above) that effectively reduces the number of shafts to a total of three. FIG. 11 details schematically the arrangement 1100 of power transmission shafts as viewed from below the table 124. The bottom of the figure represents the area nearest the front face of the device, while the top represents the area nearest the rear face of the device. The sides of the figure are oriented in the upstream-to-downstream direction. The device is powered by a central drive motor 1110. The motor 1110 is mounted to the underside of the table using conventional motor mounts that can include conventional vibration-damping components. The motor 1110 can be any acceptable type, typically with a variable speed capability and operated by AC electric power (typically 110 VAC, 220 VAC and/or 440 VAC, single-phase or three-phase). The motor 1110 is connected by a sprocket 1112 and drive chain or belt 1114 to a driven sprocket 1116 mounted on the first, continuous motion shaft 1120 (continuous rotary motion being represented by a solid curved arrow 1122). The shaft 1120 is supported by at least two bearings 1124 and 1126 at opposing ends thereof. The bearings can be presses or otherwise secured into mountings that are attached to or integral with the underlying table 124. The continuous shaft 1120 drives device components which require a continuous rotary output using each of a plurality of take-offs 1128. Some takeoffs (1128) are chain or gear drives for transferring direct rotary motion, while others operate pivoting bars or slides where a reciprocating, linear or arcuate motion is needed.

Figure 12:
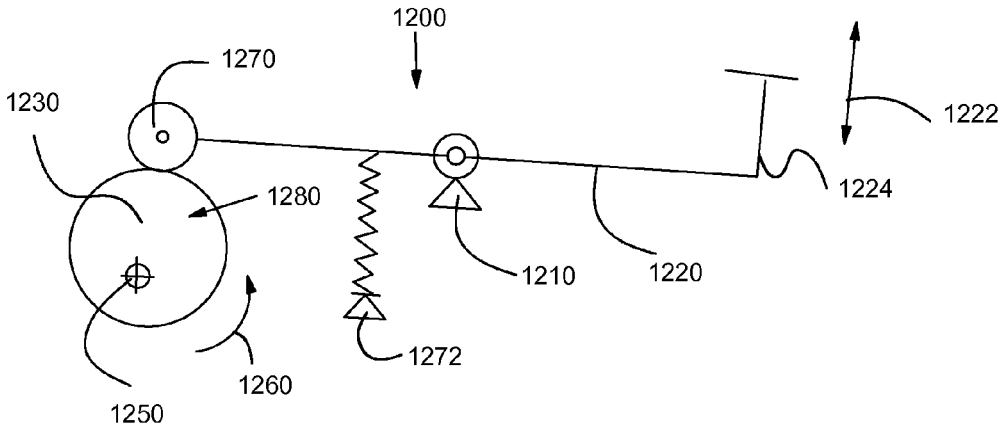
FIG. 12 is a schematic side view of a an eccentric-cam-driven pivot bar applicable to the shaft arrangement of FIG. 11.

Referring briefly to FIG. 12 a pivoting bar takeoff 1200 that can be driven by the shaft arrangement 1100 is shown. The takeoff 1200 includes a bearing fulcrum 1210 that is secured to the table 124 or other part of the device 100. The fulcrum 1210 allows a drive bar 1220 to reciprocally pivot thereby producing a generally linear reciprocating motion (double arrow 1222) at an end actuator 1224. The bar is driven by a cam 1230 with a circular or non-circular (e.g. lobular) perimeter mounted eccentrically with respect to the shaft 1250 (representative of any shaft in the arrangement 1100). The shaft rotates in either direction (arbitrarily shown as curved arrow 1260) to cause a cam follower 1270 to rise and fall against the undulating surface 1280 of the cam 1230. The cam follower 1270 can be either a solid, non-moving, low-friction component, or a rotating wheel like that shown in FIG. 12. A tension (or compression) spring can be fixed to the device at a base 1272, and bias the arm 1220 against the cam 1230 so as to ensure an accurate path of travel for the follower 1270 relative to the moving cam 1230.

Figure 13:
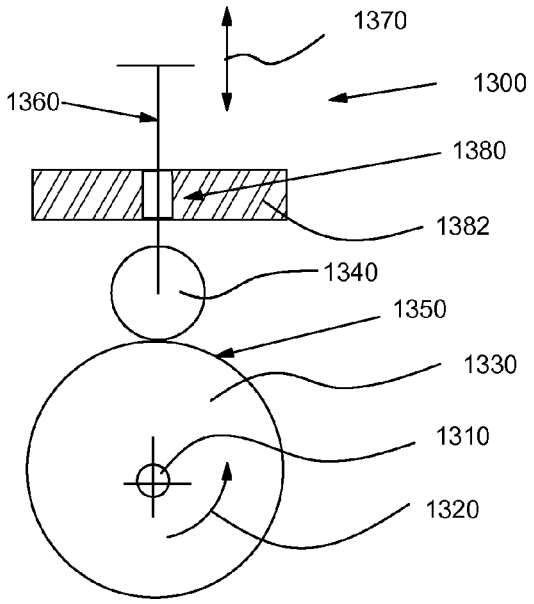
FIG. 13 is a schematic side view of an eccentric-cam-driven slide bar applicable to the shaft arrangement of FIG. 11.

FIG. 13 details an alternate implementation of a linear drive takeoff 1300. In this embodiment, the exemplary shaft 1310 rotates (curved arrow 1320) an eccentric cam 1330 that contacts an overriding fixed or rotating follower 1340 that bears against the cam surface 1350, either by weight or spring bias. The follower 1340 is directly connected to a linear actuator arm or shaft 1360 that transmits reciprocating motion (double arrow 1370) to a desired device component. Note that a chase or channel 1380 is provided through the table (124) or other device surface 1382 to allow the actuator 1360 to pass therethrough.

Referring again to FIG. 11, as discussed above, the continuous shaft 1120 typically contains takeoffs 1128 that drive such system components as the raceway hold-down lift, envelope-flap-opening suckers, open-flap clamping mechanism, envelope hopper elevator and envelope hopper pusher. The continuous shaft includes a drive sprocket 1140 and drive chain 1150 that connect to a driven sprocket 1152 on a parallel second shaft 1160. The driven section 1162 of the shaft 1160 is mounted on bearings 1164 that are also fixed to the underside of the table 124. This shaft section 1162 is driven at a faster, 2:1 ratio with respect to the first continuous shaft 1120 by providing differently-sized sprockets 1140, 1152. This shaft includes a bevel gear 1166 at the front end to drive a perpendicularly (90-degree) offset bevel gear 1165 on a perpendicular (aligned upstream-to-downstream) third shaft 1170 also mounted on fixed bearings 1172. This shaft includes the takeoff 256 (FIG. 2) that drives the swing arm assembly (arm 250), and a takeoff 1174 that drives contents pusher fingers in the envelope insertion section. Since both of these components require reciprocating motion that is perpendicular to the upstream-to-downstream feed direction, the shaft 1170 is, thus, aligned with a rotational axis in the feed direction. This shaft 1170 rotates (curved arrow 1176), using gear reduction, at a speed of ½ the speed of the second continuous shaft 1120, thereby providing the requisite duty cycle of its interconnected components.

The opposing end of the shaft section 1162 of the overall (second) shaft assembly 1160 is connected to the driven member of an indexer assembly 1180. A variety of indexer designs known in the art can be employed to implement the indexer assembly 1180. In this embodiment, the indexer includes a cam 1182 and follower 1184 on the end of a crank-arm that is connected to the intermittent shaft section 1186. Likewise, this shaft section 1186 is secured by fixed bearings 1188 to the underside of the table 124. As should be capable of implementation by one of ordinary skill, the driven cam 1182 of this embodiment includes spring loaded-gate that directs the follower into an eccentric slot that captures the follower and cranks it through one revolution. Since the second shaft assembly 1162 moves at twice the speed as the first shaft assembly 1120, the indexed section of the second shaft assembly's one revolution equals half a revolution for the first shaft (and its components' duty cycle). The gate releases the follower 1184 from the indexer's eccentric slot on the second revolution of the second shaft's driven section 1160 and the follower/crank assembly idles during this second revolution. Thus the second shaft's indexed section 1162 rotates one revolution during half the rotation cycle of first shaft, while pausing during the other half of the first shaft's cycle. This provides the requisite intermittent rotary motion (designated by dashed arrow 1190) needed to drive and pause the lugged raceway belt (280 in FIG. 2) in each cycle. This intermittent operation is desired because the raceway belt should briefly pause for contents to be deposited on the raceway by still-moving grippers, and also pause for contents to be inserted downstream into waiting, flap-opened envelopes by contents pushers. A drive sprocket takeoff 1192 is provided to the intermittent shaft section 1186 so as to drive the raceway belt as described above.

Figure 14:
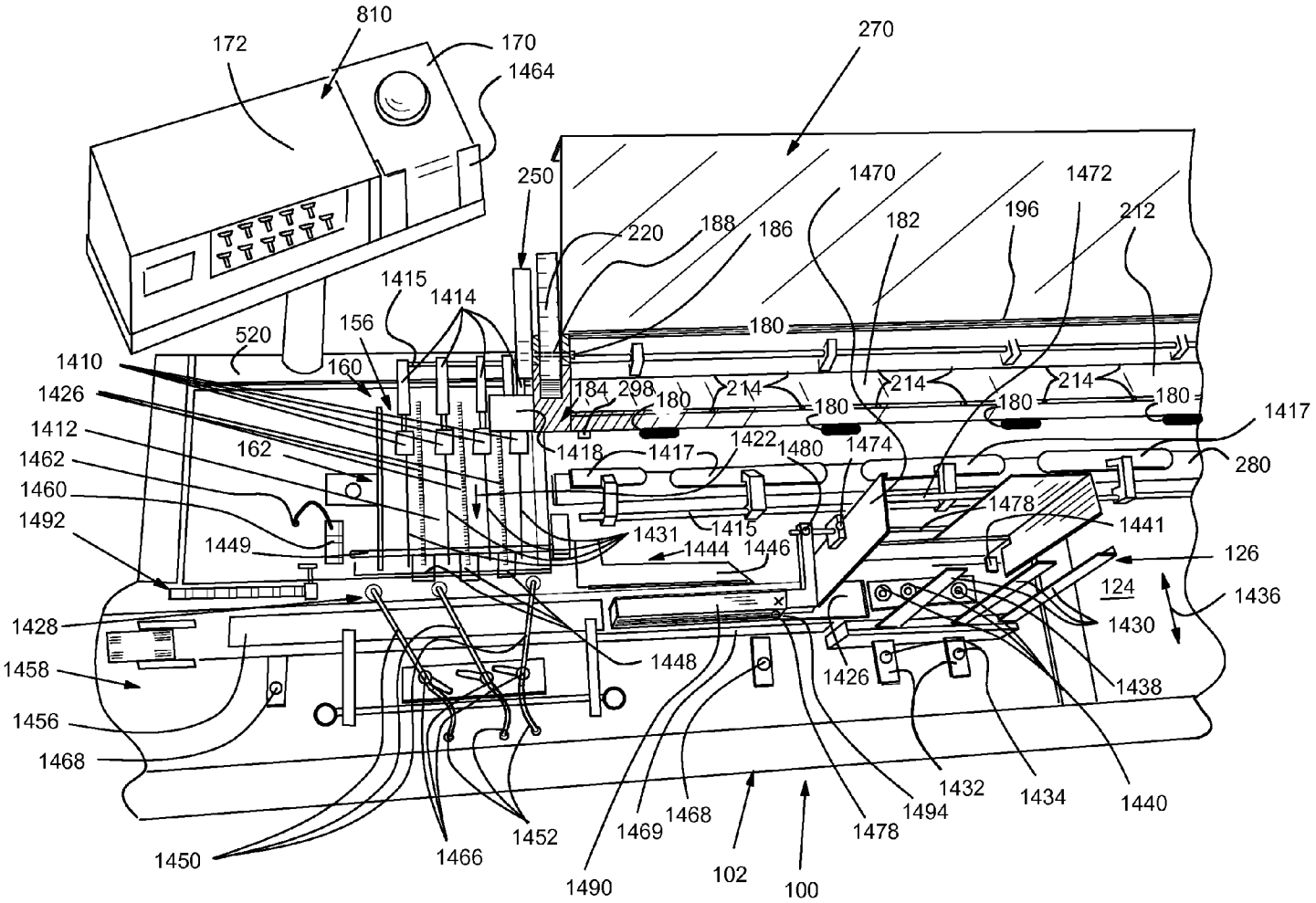
FIG. 14 is a top view of the envelope insertion area of the inserter of FIG. 14.

Reference is now made to FIG. 14, which shows a top view of the insertion area 156 of the device. The insertion area receives contents from the raceway 280 where they are deposited in a contents insertion transfer station 162 that includes a set of side-by-side contents pusher fingers 1410. The pusher fingers are constructed from a durable material, such as a hard plastic. They slide along an underlying feed surface 1412 that can be constructed from a ferromagnetic material. While not shown, each of the contents pusher fingers 1410 includes a strong magnet (not shown) in its base that allows it to remain securely, but slidably engaged to the plate 1412. The pusher fingers 1410 are pivotally mounted on extension arms 1414 that project rearwardly to a pivot shaft 1415. The pivot shaft is secured to a drive arm 1418. The drive arm is secured by a base to the swing arm 184. In this manner, each time the lug belt 280 delivers a new contents to the plate 1412 of the transfer station 162, the swing arm 182 urges the pusher fingers 1410 forwardly to drive (arrow 1422) the contents transverse to the downstream direction and towards a waiting opened envelope that has been transferred from the hopper 126 along an envelope conveyor belt 1425 to an envelope stuffing station 1428. The contents pieces arrive at the transfer station 162, and are driven under a set of parallel brushes 1425 that hold the contents flat for the pusher fingers 1410 to thereafter drive each delivered contents piece into the waiting envelope. The pusher finger pivot shaft 1415 rides on a ramp (not shown) that allows the fingers to rise above the incoming contents insert when withdrawn to a rearmost position after feeding. Unlike prior art, this ramp is not adjustable, and is rigid so it cannot be bent out of shape and does not contact the transfer station. As such the ramp causes none of the potentially annoying clinking sound experienced with prior art ramps. The ramp has a discontinuity at its rearmost location that causes the bar to drop back down, returning the fingers 1410 into contact with the underlying plate 1412. The transfer station plate 1412 can include a rubber landing zone to further eliminate noise, grooves 1431 that interlock with the fingers to prevent insert material from inadvertently passing underneath as they 1410 reciprocate therealong.

Note that the raceway includes overlying raceway contents hold down "skis" 1417 that are each mounted on a common rotating shaft 1415. The hold downs 1417 normally overlie the contents as they pass downstream on the raceway. The hold downs 1417 retract as the grippers 180 deliver contents onto the race way so as to provide clearance for the grippers 180 to deposit their respective contents thereon. The hold downs then reengage as the contents move along the race, again retracting, and opening for the next gripper-delivery cycle. In the illustrative embodiment, the hold downs can be metal plates that do not actually engage the contents with pressure, but rather reside approximately one quarter to one half inch above the belt. This geometry boxes in the material so it remains on the moving belt. Also, the upstream edge of each hold down can include an upwardly ramped end to help guide the contents thereunder. In general, the hold downs serve to prevent contents from becoming unfolded or otherwise falling off the race way. In this manner, the contents remain under physical control and engagement of a paper-handling device during substantially all stages of the process (with the grippers handing that control/engagement responsibility off to the hold downs during the raceway-delivery stage of the process).

Note further that the envelope hopper 126 includes a series of uprights 1430 that are secured to the table 124 by slotted brackets 1432 and thumb screws 1434. Thus, the spread of uprights in the envelope hopper 126 can be adjusted for envelope width (double arrow 1436) by sliding the brackets 1432 appropriately and locking the screws 1434. Beneath the hopper resides a moving envelope elevator 1438 that is powered by the continuous power transmission shaft described above. The elevator includes a series of suction cups 1440 to which a vacuum is applied under control of the controller to intermittently grasp and release envelopes drawn from the bottom of the hopper. Unlike prior art, each and every of these cups is independently connected to a respective vacuum chamber. Therefore, if one sucker does not make contact and looses vacuum, the other suckers will still perform. Hence, the suckers can each be said to obtain suction from an "independent vacuum source." Envelopes, which are drawn by the elevator 1438, are then engaged and driven onto the belt 1426 by a rod-mounted pusher block 1441 which drives the upstream edge of each drawn-down (by the elevator) envelope out of the bottom of the hopper stack, and onto the envelope drive belt and flap plow assembly 1444.

Envelopes are thereby vacuum-released onto the envelope conveyor belt 1426 where they are pushed into a waiting nip arrangement. The envelopes are grasped by a nip defined between the belt and a clamp bar (1478, described further below) that applies a predetermined pressure to the belt. When driven from the hopper, the envelope flaps are in a closed position. They pass through a flap-opening section 1444 that includes an overriding flap plow 1446 that engages a closed flap, and biases it open. The flap then engages a knife, whose leading edge is above the top surface of the incoming envelope behind the flap section, but transitions to below the flap before it contacts the flap. This geometry ensures the knife will scrape the flap open, even if the subsequent upstream flap plow does not open. As such the opened flap is rotated by the plow at its seam 180 degrees, laying the flap flat against the working surface of the feed table. When the belt completes its cycle, the opened envelope stops with its opened side in registration with the stuffing station 1428—where a series of grippy, springy hold-downs 1448 retain the flap in the desired laid-flat, opened orientation, firmly engaged against the underlying feed table supporting surface. The hold downs 1448 can be constructed from any acceptable resilient sheet material including a thin metal, rubber, or another flexible or semi-rigid polymer, cut into a narrow (½-1½-inch) strip. The hold downs 1448 are mounted adjustably on an overlying bar 1449. They exhibit a slight curve to provide spring force against the underlying surface/flap.

With the envelope flap held down, a series of vacuum (suction cup) lifters 1450, which are fed by independent vacuum lines 1452 move up and down to selectively draw up the opposing non-flap portion side of the envelope. This serves to open the mouth of the envelope for insertion of contents.

The transfer station also contains a set of envelope fingers that serve to transition the material from the pusher fingers. When the envelope is pulled open, the envelope fingers, which are uniquely wider than the incoming inserts and have a novel shaped front edge, are driven into the envelope ahead of the insert contents pieces. This insures the envelope is opened sufficiently when the pusher fingers 1410 subsequently drive contents transversely (to the downstream direction) into the pulled-open envelope.

The lower side of the non-flap edge (closer to the device front) of the envelope is driven into position as it is held between the belt 1426 and a hold-down bar 1448. The hold-down bar in this embodiment includes any acceptable clamping mechanism that allows the envelope to be driven along the belt 1426 while sliding against the hold-down bar 1448. This bar is raised once the envelope is clamped to allow the incoming insert contents room. Once the contents are completely engaged inside the envelope, the hold-own bar returns to its down-and-clamped position. The envelope can eventually exit the outlet 1458 when filled with contents in the next envelope-belt-movement cycle.

As the envelope exits the outlet 1458, it passes under an illustrative wetting brush 1460 arrangement. The wetting brush is fixed in position, slightly higher than the incoming envelope but the flap is driven up into it and drip-fed by a tube 1462 from the overlying reservoir 170 shown above. A valve controls a gravity-feed, or pump-feed, of water from the reservoir 170 to the brush 1460. This wets the filled envelope flap adhesive as the envelope exits the stuffing station 1428 on the next belt (1426) cycle. Its flap is then folded by an illustrative folding ramp assembly 1492. The unique geometry ensures that even if the inserter stops, envelopes with wet flaps will be drawn to the flap closing and sealing section. Note in this embodiment, the liquid reservoir 170 has been placed in a mounting 1464 that is on the opposing side of the control console from the side shown in the view of FIG. 1. In practice, the reservoir 170 can be placed at any convenient location on the device and/or console. Notably, in the depicted elevated position, the reservoir is much higher and wider than that of the prior art. This placement ensures that, in the illustrative gravity-fed embodiment, the liquid pressure in the wetting brush is high, and remains relatively constant even as the water level diminishes before refilling the reservoir.

In the illustrative embodiment, a series of levers 1466 and thumbscrews 1468 allow the relative width of the downstream inserter components to be varied. In particular, a raised front guide edge 1469, which restricts transverse movement of the lower (device-front-adjacent) edge of the envelope along the feed path, is adjustable using the screws 1468. This allows for varying width envelopes to be accommodated. An informed operator can easily readjust both the hopper 126 and downstream components to accommodate differing widths.

Notably, prior art insertion devices typically require substantial readjustment of the feed/insertion components of the device to accommodate differing upstream-to-downstream width envelopes due to changes in envelope leading edge registration with respect to their stuffing station (assuming the timing and degree of envelope transport does not vary to accommodate different registration lengths. However, the novel insertion device 100 of this embodiment allows for a very simple upstream-to-downstream registration adjustment due to changes in the fed envelope's width. In this embodiment, the front/envelope leading edge guide 1470 of the hopper 126 is slidably adjustable along an upstream-to-downstream guide bar 1472 that allows for different envelope widths to be quickly accommodated. The belt 1426 has an upstream edge 1478 that is positioned so that it will engage contents within the expected range of widths to be accommodated. The hopper front guide 1470 is locked into a position along the bar 1472 by a locking screw 1474. Of course, any acceptable mechanism, including automated (rack-and-pinion, for example) mechanisms, can be used to move and lock the envelope hopper front guide in a desired position.

Once the hopper's front guide 1470 is adjusted to accommodate a given width of envelope, the leading edge of the envelope must be registered to arrive at the appropriate location with respect to the stuffing station 1428. Otherwise contents will jam because they will not be aligned with the opening. If the location of the leading edge changes, but the point at which the envelope becomes grasped by the belt 1426 does not change, then the envelope will arrive out of phase with the stuffing station. One solution would be to change the length of the belt cycle in view of change in front guide location. However, a more reliable solution is to maintain a constant cycle length of the belt 1426 for all envelope widths, and to change the timing upon which different sized enveloped become grasped by the belt (which may already be in motion for a small time) once they are delivered from the hopper 126 by the pusher finger 1441. The phasing of entry onto the belt is, thus, adjusted by moving a weighted clamp bar 1490, which overrides the belt in an upstream-to-downstream direction use of the locking screw 1480 that engages an adjustment slide bar 1478. In this manner, the weighted clamp bar 1490 can be set at a predetermined in an upstream to downstream direction. The attached flap plow assembly 1444 is likewise movable with the clamp bar. In this manner so that the upstream-to-downstream registration of the flap plow can also be adjusted. The upstream edge of the clamp bar engages the belt with a clamp nip (denoted by the "X" 1494) that, with the appropriate timing, initiates grasping of the leading edge of an envelope and subsequent driving of the envelope downstream to the stuffing station 1428. Explained briefly, the belt 1426 in this embodiment always moves the same distance value with each cycle. Likewise, the pusher always drives the trailing edge of the envelope from the bottom of the hopper 126 with the same synchronized timing as the belt's movement. Thus, by changing where the nip 1494 first engages the leading edge of the fed envelope, the final location of the leading edge when the belt stops moving can be accurately regulated/registered. This allows the leading edge to arrive at the correct, registered location with respect to the stuffing station 1428 when the belt stops. A grasping nip can be constructed in a variety of ways. In one embodiment, the nip comprises a weighted roller or ball contained within the bar 1490 that contacts the belt 1426. However, it is expressly contemplated that any mechanism that allows the belt or other transport mechanism to grasp the envelope leading edge, and thereafter carry it downstream at the appropriate time and phasing, can comprise a nip in accordance with this invention.

The upstream/downstream adjustment of the clamp bar 1490 and associated nip 1494 can be accomplished in a variety of manual and/or automated ways. For example, in an alternate embodiment a drive screw attached to a servo motor (or other controllable actuator) can be used to apply predetermined adjustments in view of the position of the hopper front guide 1470. Likewise, the clamp bar may remain relatively stationary in an alternate embodiment, while the location of the grasping surface or nip is adjusted in an upstream to downstream direction.

In summary it should be clear that the above-described components, mechanisms and procedures afford superior performance, ease of maintenance, servicing and adjustment to the overall envelope insertion device described herein.

The foregoing has been a detailed description of illustrative embodiments of the invention. Various modifications and additions can be made without departing from the spirit and scope if this invention. Each of the various embodiments described above may be combined with other described embodiments in order to provide multiple features. Furthermore, while the foregoing describes a number of separate embodiments of the apparatus and method of the present invention, what has been described herein is merely illustrative of the application of the principles of the present invention. For example, the shape, size and layout of the housing and various components are each highly variable. Likewise, in alternate embodiments certain components can be separately powered by additional electronic or fluid-driven motors. The materials employed for various components can be widely varied as well. Accordingly, this description is meant to be taken only by way of example, and not to otherwise limit the scope of this invention.

What is claimed is:

1. A system for inserting contents into envelopes comprising:

an envelope hopper and an envelope pusher assembly that drives envelopes from a bottom of the hopper in a downstream direction;

an envelope transport that grasps envelopes from the pusher assembly and forwards the envelopes in the downstream direction to a stationary position at a contents stuffing station at which the envelopes each receive respective contents thereinto, the transport operating at a fixed timing with respect to the pusher assembly;

a front hopper guide that engages a leading downstream edge of the envelopes, the front hopper guide being constructed and arranged to adjustably move in an upstream-to-downstream direction so as to accommodate envelopes having differing upstream-to-downstream widths; and and wherein the envelope transport comprises a belt having a weighted clamping bar mounted thereover, the clamping bar being adjustably movable in the upstream-to-downstream direction.

2. The system as set forth in claim 1 wherein the nip is located adjacent to an upstream edge of the clamping bar.

3. The system as set forth in claim 1 wherein the stuffing station includes an envelope flap-opening assembly including a plurality of vacuum lifters, each of the lifters being interconnected with a vacuum source by each of a plurality of independent vacuum lines.

4. The system as set forth in claim 1 wherein the stuffing station includes an envelope flap-opening assembly including a wetting member supported above each of the envelopes as an opened flap passes thereover, being interconnected with a reservoir that drip feeds water thereto by gravity at a predetermined flow rate.

5. A system for inserting contents into envelopes comprising:

an envelope hopper and an envelope pusher assembly that drives envelopes from a bottom of the hopper in a downstream direction;

an envelope transport that grasps envelopes from the pusher assembly and forwards the envelopes in the downstream direction to a stationary position at a contents stuffing station at which the envelopes each receive respective contents thereinto, the transport operating at a fixed timing with respect to the pusher assembly;

a front hopper guide that engages a leading downstream edge of the envelopes, the front hopper guide being constructed and arranged to adjustably move in an upstream-to-downstream direction so as to accommodate envelopes having differing upstream-to-downstream widths; and wherein the stuffing station includes sliding pusher fingers adapted to move from a withdrawn position to drive contents from a raceway into each of the envelopes, each of the pusher fingers having a magnet disposed therein and a the stuffing station further including a magnetic pusher plate against which the pusher fingers are biased by each magnet, respectively.

6. The system as set forth in claim 5 wherein the stuffing station further includes a plurality of parallel brushes under which each of the contents is flattened as the pusher fingers drive each of the contents into a respective of each of the envelopes.

7. The system as set forth in claim 6 wherein the pusher fingers include a shaft constructed and arranged to ride over a ramp so that each of the pusher fingers rises over contents on the raceway in the withdrawn position.

8. The system as set forth in claim 7 wherein the pusher plate includes at least one of a rubber landing zone onto which the pusher fingers drop and grooves adapted to receive debris as the pusher fingers slide along the pusher plate.

* * * * *